United States Patent [19]

Bateman et al.

[11] 4,127,418

[45] Nov. 28, 1978

[54] PAPER SIZING PROCESS

[75] Inventors: Mark E. Bateman, Woodridge; Jeffrey T. Palmer, Roselle, both of Ill.

[73] Assignee: Standard Oil Company, Chicago, Ill.

[21] Appl. No.: 812,815

[22] Filed: Jul. 5, 1977

Related U.S. Application Data

[62] Division of Ser. No. 772,917, Feb. 28, 1977, Pat. No. 4,065,349.

[51] Int. Cl.[2] ..... C08L 3/04; D21D 3/00

[52] U.S. Cl. ..... 106/213; 162/158

[58] Field of Search ..... 106/213, 175, 158

[56] References Cited

U.S. PATENT DOCUMENTS 3,248,248 4/1966 Coran et al. ..... 106/181

*Primary Examiner*—Theodore Morris

*Attorney, Agent, or Firm*—William C. Clarke; Arthur G. Gilkes; William T. McClain

[57] ABSTRACT

Paper sizing process comprising (1) adding a sizing composition of a cationic retention aid and a monoester of a benzene carboxylic acid anhydride having from 6 to 60 carbon atoms in the ester group to an aqueous pulp suspension or paper stock prior to web formation, and (2) heating said sized paper web to a temperature of from 80° to 150° C.

8 Claims, No Drawings

PAPER SIZING PROCESS

This is a division of application Ser. No. 772,917, filed Feb. 28, 1977, now U.S. Pat. No. 4,065,349.

BACKGROUND OF THE INVENTION

This invention relates to a paper sizing process for internal sizing of paper and paperboard products by adding to an aqueous pulp suspension or paper stock a composition of a cationic retention aid and a monoester of a trimellitic acid compound or a pyromellitic acid compound having from 6 to 60 carbon atoms in the ester group.

It is an object of this invention to provide improved internal sizing agents whose use results in the preparation of paper which has reduced water and ink absorption as well as improved resistance to aqueous acid and alkaline solutions. A further object of this invention involves the use of sizing agents which may be employed with all types of paper pulp over the complete range of pH conditions which are normally encountered in paper manufacturing. An additional object involves the use of paper sizing agents which are fully compatible with alum and rosin as well as with the various fillers, pigments and other chemicals which may be added to paper.

Paper and paperboard are often sized with sizing agents for the purpose of retarding or preventing penetration of aqueous liquids into the structure. This is commonly done by introducing a material into the paper making pulp during the actual paper making operation. The sizing chemicals are precipitated onto the fibers for the purpose of controlling penetration of liquids into the final dry paper or paperboard. This process is known as internal sizing. On the other hand, surface sizing involves the application of dispersions of film-forming substances such as converted starches, gums and modified polymers to already formed paper or board.

Among the principal internal sizing agents which have been used are partially saponified rosin, asphalt, fortified rosin or a mixture of rosin and wax with aluminum sulfate (papermaker's alum), wax emulsions, ketene dimer emulsions, alkyl succinic anhydrides, fatty acid anhydrides, fluorocarbons, fatty acid complexes of chromium or aluminum chlorides, long chain thermoplastic copolymers as well as some thermosetting condensation type resins. Although all of these materials are useful under certain conditions, their effectiveness is nevertheless subject to certain limitations.

Rosin size has been widely used as an internal size since it was first discovered. It is inexpensive and easy to use. However, the rosin size precipitate deposits on the fibers in relatively thick particles and because it is an aluminum salt, it is attacked by acids and bases. Wax, the other most commonly used internal size, is hydrophobic, inert and on melting flows over the fibers as a thin film for good distribution. Wax, however, is not substantive to cellulose and does not adhere firmly to the fibers. Wax is often added as an emulsion which is retained mechanically by co-precipitation with alum. When used with rosin size, the rosin precipitate can act as a substrate for attachment of the wax to the fiber surface. Most wax emulsions cannot be used on the alkaline side since they are usually combined with alum to break the emulsion. On the other hand, certain sizing agents will not tolerate appreciable quantities of alum or highly acidic conditions. In certain cases, it may be desirable or even necessary to use alum for filler retention purposes, to retain or set condensation resin additives, to increase sheet drainage, etc.

Many of the sizing agents, moreover, have been found to be incompatible with the pigments, fillers and other ingredients which are often added to paper. Furthermore, many of the sizing agents are inadequate for many applications which require paper or paperboard with a high degree of water resistance. Another disadvantage of some sizing agents is that a considerable degree of heat curing is necessary to develop full effectiveness. Full effectiveness may require ageing of the paper web.

We have now discovered a process that comprises adding an emulsified sizing composition to the aqueous pulp suspension or paper stock prior to web formation, curing the said composition onto the web by application of heat, the said composition comprising a material capable of producing cationic materials and a benzene carboxylic acid anhydride with an ester group having from 6 to 60 carbon atoms which acts as the sizing agent. Ratio of cationic retention aid to benzene carboxylic acid anhydride monoester sizing agent is in the range of 0.05:1.0 to 2.0:1.0, retention aid to sizing agent, i.e., the monoester of a benzene carboxylic acid anhydride which acts as the sizing agent.

The process results in paper and paperboard products which have a high degree of water resistance as well as resistance to highly acid and highly alkaline solutions. The new sizing process can tolerate a wide range of pH from strongly basic to highly acid conditions. The sizing process can tolerate and can be used in conjunction with alum as well as any of the pigments, fillers and other ingredients which may be added to paper with the exclusion of calcium carbonate filler. Another advantage of this process is that the sizing agents of the process do not detract from the strength of the paper and act additively when used with certain other ingredients to increase the strength of the finished paper. Only mild curing conditions are required to develop full sizing properties.

For purposes of this invention, the terms "paper" and "paperboard" are defined as semisynthetic products made by chemically processing cellulosic fibers into sheet-like forms and molded products. Also included are blends of cellulosic fibers with synthetic materials such as polyamides, polyacrylics and polyesters.

In this novel process, an internal paper sizing composition comprising an aqueous emulsion of a material capable of producing cationic materials and a benzene carboxylic acid anhydride having an ester group of from 6 to 60 carbon atoms are added to an aqueous pulp suspension or paper stock, as in the beater of a paper making system or at any point prior to web formation, in a concentration of about 0.001 to 1% by weight, benzene carboxylic acid anhydride sizing agent to dry pulp. When the process applies the sizing composition in the proper concentration, the process is effective in improving water and ink absorption of the paper and paperboard products as well as improving resistance to aqueous acid and alkaline solutions over the entire pH range of about 2 to 10 which is normally encountered in making and using paper. The ester group is from 6 to 60 carbon atoms. At least 6 carbon atoms are required for hydrophobic properties to be present in the sizing agent. Approximately 60 carbon atoms is the practical limit because of decreased sizing efficiency resulting from the long carbon chains. Preferred chain length is from 14 to 22 carbon atoms because of desirable hydrophobic properties and sizing efficiency. The carbon chain can be saturated or unsaturated with one or more olefinic linkages. Examples of compounds from which the ester groups are derived are hexanol, octadecanol, octadecenol, hexadecanol, hexadecenol, tetradecyl glycidyl ether, dodecyl gycidyl ether, tetradecanol, tetradecenol, octadecenyl acetate, benzyl alcohol, dosocanol, epoxidized soybean oil, safflower oil and other vegetable oils containing at least one olefinic group and carbon chains of $C_{10}$ to $C_{18}$ chain length.

The unsaturated alkenyl monoesters offer the advantage of lower melting points. An octadecenol ester, a $C_{18}$ with one double bond at the $C_9$ position, for example, had a melting point at approximately room temperature, about 25° C., where alkyl monoesters of similar chain length had melting points close to 80° C. Although the alkyl monoesters were good candidates for sizing compositions, the higher melting points made them more difficult to emulsify than the olefinic compounds.

The benzene carboxylic acid moiety is derived from benzene compounds having a total of three or four acyl groups, two of which must be vicinal to each other to form an anhydride grouping. The anhydride grouping is essential to provide carboxyl groups to react with the free hydroxyl groups of the cellulosic fibers of the pulp and provide durable attachment to the the web. If three acyl groups are present, the ester group is attached to the acyl group which is not part of the anhydride group. If four acyl groups are present, two of the groups must be vicinal to form an anhydride and at least one of the other two acyl groups must be esterified. The fourth acyl group of pyromellitic anhydride can also be esterified to form a diester which can be used in the same process as taught for the monoester. Specific examples of aromatic compounds suitable for use in the sizing composition are 4-alkenyl monoesters of trimellitic anhydride or pyromellitic anhydride, 4-alkyl monoesters of trimellitic anhydride or pyromellitic anhydride as well as 4-aralkyl and 4-aralkenyl monoester derivatives of trimellitic and pyromellitic anhydrides, said ester groups containing 6 to 60 carbon atoms. Typical examples of these are 4-n-hexyl trimellitate anhydride, 4-n-octadecenyl trimellitate anhydride, 4-n-octadecyl trimellitate anhydride, 4-n-hexadecenyl trimellitate anhydride, 4-n-hexadecyl trimellitate anhydride, 4-n-tetradecenyl trimellitate anhydride, 4-n-tetradecyl trimellitate anhydride, 4-n-dodecyl trimellitate anhydride, 4-n-decyl trimellitate anhydride, 4-benzyl trimellitate anhydride, 4-($\beta$-hydroxy-$\gamma$-n-tetradecylether) trimellitate anhydride, 4-n-octadecyl-5-carboxyl pyromellitate anhydride, etc.

Because the cellulosic fibers of the pulp stock are anionic and the benzene carboxylic acid anhydride having the monoester is also anionic, a cationic retention aid is required. This can be a material which is cationic in nature or is capable, when used with the said monoester of producing or associating in such a way as to produce cationic materials. Among these materials which can be used as cationic retention aids or sources of cationic agents in the novel process are alum, aluminum chloride, long chain fatty amines, sodium aluminate, polyacrylamide (Separan CP-7, Dow Chemical Co.), chromic sulfate, natural gum base (Gendriv 158, General Mills), cationic thermosetting resins (Kymene 917, Hercules, Inc.) and polyamide polymers (Reten 304, Hercules, Inc.). Various cationic starch derivatives are especially useful, including primary, secondary, tertiary or quarternary amine starch derivatives and other cationic nitrogen substituted starch derivatives as well as catinic sulfonium and phosphonium starch derviatives. Such derivatives can be prepared from all types of starches including corn, tapioca, potato, waxy maise, wheat and rice. These starches must be cooked if an original granular form but they can be used as is if in a pregelatinized, cold water soluble form. An example of a quaternary amine starch derivative is Q-Tac 3894 (CPC International, Inc.) which has a D.S. (degree of substitution) of the range of 0.025 to 0.03. It is a corn starch which has been etherified with a quaternary ammonium salt to the desired degree of substitution.

Briefly, the emulsified composition used in the sizing process is preferably an emulsion of a cationic starch paste and the said monoester of the benzene carboxylic acid anhydride. Alternative procedures can be used in the preparation of the sizing composition. An unmodified starch without cationic characteristics or a surfactant can be used for economic reasons to emulsify the monoester but a cationic agent such as alum or others from the aforementioned group would necessarily be used as a cationic retention aid. These cationic retention aids can be added to the pulp stock in conjunction with the sizing emulsion of unmodified starch or surfactant and monoester or prior to or after the addition of the sizing emulsion. Pick-up of the emulsified sizing composition by the paper or paperboard web in the desired concentration, upon heat-curing, results in improved water and ink absorption, as well as improved resistance to aqueous acid and alkaline solutions. The heat cure is obtained by heating the paper web at temperatures of from about 80° to 150° C. as it passes through the heated rolls of the paper machine. Further curing of course occurs during storage prior to use. Other heating methods can be utilized.

The process of this invention can be used to size cellulosic fibers of pulp from bleached and unbleached sulfite, bleached and unbleached soda, neutral sulfite, semi-chemical, chemigroundwood, groundwood and any combination of these fibers, prepared by any of a variety of processes which are available in the industry. Synthetic fibers of viscose rayon or regenerated cellulose also can be sized.

Many pigments and fillers can be added to the pulp in conjunction with the addition of the sizing composition. These can be added during or after the sizing process or may be present in the aqueous pulp suspension or paper stock before the addition of the sizing composition. These include clay, talc, and titanium dioxide.

The monoesters used in the sizing process are prepared by esterifying trimellitic anhydride or pyromellitic anhydride with a monohydric alcohol, epoxide or vegetable oil containing at least one olefinic linkage and carbon chains of $C_{10}$ to $C_{18}$ chain length. The alcohol, epoxide or vegetable oil can contain from 6 to 60 carbon atoms.

In the case where an alcohol is used, the esterification can be a trans-esterification reaction. The alcohol is esterified with acetic acid or acetic anhydride. The acetate ester is then reacted with a benzene carboxylic acid anhydride having 3 or 4 acyl groups at least two of which are vicinal to form an anhydride grouping. One mole of the benzene carboxylic acid anhydride is reacted with one mole of the esterified alcohol.

Esterification by trans-acidolysis often uses a catalyst such as p-toluenesulfonic acid, antimony oxide, magnesium metal, titanium butoxide, zinc or sodium acetate. The reaction is postulated as proceeding through an initial hydrogen bonding of the ester with the carboxylic acid group which increases the electrophilic character of the carbonyl group. This favors attack by the carboxylate anion, producing a four-membered transition state intermediate in which exchange occurs with formation of an acid and an ester bond.

In order to facilitate a clear understanding of the invention, the following specific embodiments are described in detail. It should be understood, however, that the detailed expositions of the application of the invention, while indicating preferred embodiments, are given by way of illustration only since various changes and modifications within the spirit and scope of the invention will become apparent to those skilled in the art from this detailed description.

EXAMPLE I

Octadecenyl acetate was prepared in an esterification procedure and then reacted with trimellitic anhydride (TMA) in a trans-acidolysis procedure to prepare a 4-monoester of TMA, 4-n-octadecenyl trimellitate anhydride.

A mixture of 268 grams (1 mole) of octadecenol and 102 grams (1 mole) of acetic anhydride was charged to a 500 ml round bottomed three-necked flask equipped with a thermometer, a nitrogen gas sparge tube, cold water condenser and containing a few boiling beads. The mixture was refluxed for 8 hours at about 155° C. to complete the esterification. An elbow tube was then put into the top of the flask so that the cold water condenser could be angled downward to collect the acetic acid generated by the esterification of the octadecanol and the acetic anhydride. After collecting 60 grams (1 mole) of acetic acid, the reaction was stopped and 192 grams (1 mole) of TMA was added with 0.2 (wgt)% (1.0 grams) sodium acetate as a trans-acidolysis catalyst. The mixture was gradually heated to a maximum of 315° C. over a period of 240 minutes to remove 60 grams (1 mole) of acetic acid. The acid number of the 4-monoester, the 4-n-octadecenyl trimellitate anhydride, was 254 (milligrams of KOH to neutralize 1.0 grams of 4-monoester).

EXAMPLE II

Octadecyl alcohol was reacted by thermal esterification with trimellitic anhydride (TMA) to prepare a 4-monoester of TMA, 4-n-octadecyl trimellitate anhydride.

A mixture of 270 grams (1 mole) of octadecanol and 192 grams (1 mole) of TMA was added with 2.0 grams of p-toluenesulfonic acid to a 500 ml round bottomed three-neck flask equipped with a thermometer, a nitrogen gas sparge tube, Dean-Stark trap and cold water condenser, and mechanical stirrer. The mixture was first heated to 242° C. for 2 hours and then to 294° C. for an additional 4 hours. Only two thirds of the expected $H_2O$ (i.e., 12 milliliters) was collected. The product was vacuum stripped and purified by recrystallization from methyl isobutyl ketone. The final product, the 4-n-octadecyl trimellitate anhydride, had an acid number of 294 (Mg KOH/gram product).

EXAMPLE III n-Hexadecanol (242 grams, 1 mole) was reacted with trimellitic anhydride (192 grams, 1 mole) in the procedure of Example II. Acid number of the final product, the 4-n-hexadecyl trimellitate anhydride, the 4-monoester, was 269.

EXAMPLE IV

An aliphatic glycidyl ether was reacted with trimellitic anhydride (TMA) to prepare a 4-monoester of TMA, 4-n-(mixed $C_{12}$–$C_{14}$ aliphatic glycidyl ether) trimellitate anhydride. The 4-monoester is a mixture of 4-(β-hydroxy-γ-tetradecylether) trimellitate anhydride and 4-(β-hydroxy-γ-n-dodecylether) trimellitate anhydride.

A mixture of 286 grams (1 mole) of Epoxide 8 (a mixed $C_{12}$–$C_{14}$ aliphatic glycidyl ether made by Procter and Gamble) and 192 grams (1 mole) of TMA were charged to a 1000 ml round bottom three-necked flask equipped with a thermometer, a nitrogen gas sparge tube, cold water condenser anda mechanical stirrer. The mixture was first heated to 220° F. (104° C.) for 1 hour and then heated at 260° F. (127° C.) for an additional hour. Acid number of the final product, the 4-n-(mixed $C_{12}$–$C_{14}$ aliphatic glycidyl ether) trimellitate anhydride, the 4-monoester, was 187.

EXAMPLE V

Ester groups of up to 60 carbon atoms are attached to the 4-position of the TMA molecule as in Examples V and VI.

Safflower oil containing approximately 78% octadecadienoic acid is reacted by thermal esterification with trimellitic anhydride (TMA) to prepare a 4-monoester of TMA, 4-($COOCH(CH_2OCOC_{17}H_{31})_2$) trimellitate anhydride.

A mixture of 880 grams (1 mole) of safflower oil and 192 grams (1 mole) of TMA is added to a 500 ml round bottomed three-necked flask equipped with a thermometer, a nitrogen gas sparge tube, cold water condenser and containing a few boiling beads. The mixture is refluxed for 2½ hours at 500° C. to complete the esterification to 4-($COOCH(CH_2OCOC_{17}H_{31})_2$) trimellitate anhydride. The TMA-safflower oil acidolysate $C_{48}H_{70}O_9$ has the approximate structure

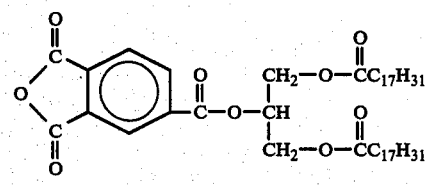

EXAMPLE VI

An epoxidized soybean oil is reacted with trimellitic anhydride (TMA) to prepare a 4-monoester of TMA.

A mixture of 950 grams (1 mole) of Epoxol 7-4 (an epoxidized soybean oil with a minimum of 7% (wgt.) oxirane oxygen made by Swift and Company) and 192 grams (1 mole) of TMA are charged to 2000 ml round bottom three-necked flask equipped with a thermometer, a nitrogen gas sparge tube, cold water condenser and a mechanical stirrer. The mixture is first heated to 220° F. (104° C.) for 1 hour and then heated at 260° F. (127° C.) for an additional hour to complete the esterification to 4-(epoxidized soybean oil with a minimum of 7% oxirane oxygen) trimellitate anhydride.

EXAMPLE VII

Sizing efficiency was evaluated using a Pen-A-Size photometric sizing tester of Testing Machines, Inc. of Amityville, N.Y., by the following procedure:

The sized handsheets were tested for degree of sizing by measuring their resistance to penetration by an acid ink, TAPPI Standard pH2 blue ink. The penetration time was measured using a Pen-A-Size tester with an 80% screen. Thus, when the reflectance of the paper on the side opposite to the side in contact with the ink dropped to 80% of its original reflectance, the automatic digital timer stopped and this value was recorded. The average time for a set of 5 handsheets was judged to be a good measure of the degree of sizing obtained with each sizing agent. Sizing was also tested by measuring the absorption time of a drop of deionized water or 1% lactic acid in deionized water. Lactic acid solutions are used as an accepted standard in the pulp and paper industry to determine resistance to aqueous acid conditions of a severe nature.

Handsheet Preparation

A 50/50 mixture of bleached softwood kraft/-bleached hardwood kraft pulp was beaten to a 500 Canadian Standard Freeness in a laboratory Niagara Beater at 1.58% pulp solids consistency. Aliquots of the pulp slurry were added to separate buckets and diluted to 0.40% pulp solids consistency prior to chemical additions. The buckets of pulp were kept mixing continuously by means of a mechanical stirrer. The sizing agent emulsion was first added to the pulp slurry and allowed to mix for 3 minutes, followed by the addition of an alum solution, which was also allowed to mix for 3 minutes. The pH of the pulp slurry after addition of sizing agent and alum was 6.8–7.2. Aliquots of the slurry were then added to the deckle box of a Noble and Wood handsheet molder to form 3.0g (dry basis) 8 × 8 inch handsheets. The handsheets were run through a press to remove water to obtain a 30% pulp solids sheet, and while still on the forming wire, were dried by sending them one time around a 220° F. heated drum dryer. The dried handsheets were hung overnight in a 70° F. and 50% relative humidity constant temperature-humidity room before testing for sizing.

Emulsion Procedure

Two emulsion formulations were used. Formulation No. 2 contained a surfactant, sodium lignin sulfonate, to aid in the emulsification procedure.

| Emulsion Formulation #1 | Emulsification Formulation #2 |
|---|---|
| 6.00g (dry basis) Cationic Corn Starch (Q-Tac 3894)* | 6.00g (dry basis) Cationic Corn Starch (Q-Tac 3894)* |
| 182.00g Deionized Water | .25g Sodium Lignin Sulfonate |

-continued

| Emulsion Formulation #1 | Emulsification Formulation #2 |
|---|---|
| | 181.75 Deionized Water |
| 188.00g | 188.00g |
| 6.00g Sizing Agent** | 6.00g Sizing Agent** |
| 6.00g Toluene | 6.00g Toluene |
| 200.00g Total | 200.00g Total |

*CPC International, Inc.

**Benzene carboxylic acid anhydride monoester, or Fibran 68 (National Starch and Chemical Corp.) or octadecyl succinic anhydride, etc.

The following procedure was typical. A dispersion of cationic starch (Q-Tac 3894 supplied by CPC International, Inc.) and/or a dispersion of cationic starch (Q-Tac 3894) and sodium lignin sulfonate (Orzan-S, Crown Zellergack Corp., Chem. Prod. Div.) in deionized water were cooked out in a steam bath for 40 minutes. The resulting starch pastes were added to Waring Blendor bowls at 70° C. To each was added a solution of a 50/50 mixture of sizing agent emulsion in toluene. The resulting mixtures were mixed at high speed for 2 minutes to obtain a 3.0% sizing solids emulsion. The emulsions were quickly cooled to room temperature while stirring gently. The emulsions were then diluted to 0.50% sizing solids before adding to pulp slurries.

The results of the handsheet evaluations are in Tables I, II & III.

TABLE I

| Sizing Agent Addition | | Alum Addition | Time (minutes) Required For Drop To Be Absorbed By Day-Old Paper: Deionized Water | Time (minutes) Required For Drop To Be Absorbed By Day-Old Paper: 1.0% (wgt) Lactic Acid: $H_2O$ Solution |
|---|---|---|---|---|
| 1.0% | Isoctadecenyl succinic anhydride | 3.0% | 116 | 7 |
| 1.0% | 4-n-Octadecenyl trimellitic anhydride (Example 1) | 3.0% | 104 | 9 |

*Sizing agents were emulsified in 1:1 ratio with cationic corn starch Emulsification Formulation #1.

TABLE II

| Sizing Agent Addition* | | Alum Addition | Penetration Time (sec.) Of pH2 Blue Ink Using Pen-A-Size Tester |
|---|---|---|---|
| 1.0% | Fibran 68** | 2.0% | 59 |
| 1.0% | Octadecyl succinic anhydride | 2.0% | 2 |
| 1.0% | 4-n-Octadecyl trimellitate anhydride (Example II) | 2.0% | 86 |
| 1.0% | 4-n-Hexadecyl trimellitate anhydride (Example III) | 2.0% | 18 |

*Sizing agents were emulsified in 1:1 ratio with cationic corn starch using Emulsification Formulation #1.

**National Starch and Chemical Corp.

TABLE III

| Sizing Agent Addition* | | Alum Addition | Penetration Time (sec.) of pH2 blue ink using Pen-A-Size Tester |
|---|---|---|---|
| 1.0% | Fibran 68 | 2.0% | 164 |
| 1.0% | 4-n-Octadecyl trimellitate anhydride (Example II) | 2.0% | 256 |
| 1.0% | 4-n-Hexadecyl trimellitate anhydride (Example III) | 2.0% | 56 |
| 1.0% | 4-n-(Epoxide 8) trimellitate (Example IV) | 2.0% | 130 |

*Sizing agents were emulsified in 1:1 ratio with cationic corn starch using Emulsification Formulation #2 which contained the surfactant, sodium lignin sulfonate.

What is claimed is:

1. A sizing composition comprising cationic quaternary amine starch with a D.S. of the range of 0.025 to 0.03 and a monoester of a benzene carboxylic acid anhydride having from 6 to 60 carbon atoms in the ester group wherein the ratio of said retention aid to said monoester is within the range of 0.05:1 to 2.0:1.0, retention aid to monoester.

2. The sizing composition of claim 1 wherein the said starch is corn starch.

3. The composition of claim 1 wherein the said monoester is a 4-alkyl monoester.

4. The composition of claim 3 wherein the said monoester is 4-n-octadecyl trimellitate anhydride.

5. The composition of claim 1 wherein the said monoester is a 4-monoester of an aliphatic glycidyl ether.

6. The composition of claim 5 wherein the said monoester is 4-n-(mixed $C_{12}$–$C_{14}$ aliphatic glycidyl ether) trimellitate anhydride.

7. The composition of claim 1 wherein the said monoester is a 4-alkenyl monoester.

8. The composition of claim 7 wherein the said monoester is 4-octadecenyl trimellitate anhydride.

* * * * *

UNITED STATES PATENT OFFICE
CERTIFICATE OF CORRECTION

Patent No. 4,127,418 Dated November 28, 1978

Inventor(s) Mark E. Bateman and Jeffrey T. Palmer

It is certified that error appears in the above-identified patent and that said Letters Patent are hereby corrected as shown below:

| Patent Column | Line | |
|---|---|---|
| 3 | 7 | "dodecyl gycidyl" should be --dodecyl glycidyl-- |
| 4 | 4 | "catinic" should be --cationic-- |
| 4 | 2 | "quarternary" should be --quaternary-- |
| 8 | 15 | "Zellergack" should be --Zellerback-- |

Signed and Sealed this

*Fifteenth* Day of *July 1980*

[SEAL]

*Attest:*

SIDNEY A. DIAMOND

*Attesting Officer*

*Commissioner of Patents and Trademarks*